US007123849B2

(12) United States Patent
Ishii et al.

(10) Patent No.: US 7,123,849 B2
(45) Date of Patent: Oct. 17, 2006

(54) IMAGE FORMING APPARATUS, IMAGE FORMING APPARATUS CONTROL METHOD, CARTRIDGE, AND STORAGE MEDIUM

(75) Inventors: Yasuyuki Ishii, Shizuoka (JP); Masato Koyanagi, Shizuoka (JP); Koichiro Takashima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 10/898,265

(22) Filed: Jul. 26, 2004

(65) Prior Publication Data

US 2005/0025507 A1 Feb. 3, 2005

(30) Foreign Application Priority Data

Jul. 31, 2003 (JP) ..... 2003-204819
Jul. 15, 2004 (JP) ..... 2004-207976

(51) Int. Cl.
*G03G 15/01* (2006.01)
*G03G 15/00* (2006.01)

(52) U.S. Cl. ..... 399/28; 399/54; 399/399; 399/85

(58) Field of Classification Search ..... 399/13, 399/27, 28, 29, 53, 54, 82, 83, 85
See application file for complete search history.

(56) References Cited

U.S. PATENT DOCUMENTS 4,841,335 A 6/1989 Kohyama
4,885,611 A * 12/1989 Higashio et al. ..... 399/13
4,994,853 A 2/1991 Fukuchi et al.
5,379,092 A 1/1995 Takashima
6,029,018 A 2/2000 Rogers, IV et al. ..... 399/12
6,314,250 B1 * 11/2001 Miyashiro ..... 399/27
6,381,421 B1 * 4/2002 Katahira ..... 399/27
6,587,649 B1 7/2003 Yamamoto et al.
6,738,587 B1 * 5/2004 Hoene et al. ..... 399/82 X
2003/0081232 A1 * 5/2003 Maeda ..... 358/1.9

FOREIGN PATENT DOCUMENTS

EP 0 947 893 A2 10/1999
EP 1 014 213 A2 6/2000
JP 60-48658 A 3/1985
JP 60-73645 A 4/1985
JP 2001-83750 A 3/2001
KR 2001-67327 7/2001
KR 2002-57825 7/2002

* cited by examiner

*Primary Examiner*—Sandra L. Brase
(74) *Attorney, Agent, or Firm*—Fitzpatrick, Cella, Harper & Scinto

(57) ABSTRACT

In an image forming apparatus, process cartridge, and storage medium, if an image forming stop factor occurs in a cartridge of a certain color, image forming using a cartridge of another color is enabled to increase the utilization efficiency and operability of the image forming apparatus. The image forming apparatus has a plurality of detachable process cartridges including image carriers (photosensitive drums) on which latent images are to be formed and developing units which develop the latent images. When a replacement timing for at least one of the process cartridges has arrived, only the developing unit of the process cartridge whose replacement timing has not arrived is driven in accordance with the state of the cartridge whose replacement timing has arrived to perform image forming.

19 Claims, 5 Drawing Sheets

IMAGE FORMING APPARATUS, IMAGE FORMING APPARATUS CONTROL METHOD, CARTRIDGE, AND STORAGE MEDIUM

FIELD OF THE INVENTION

The present invention relates to, e.g., an image forming apparatus such as an electrophotographic copying machine or electrophotographic printer, an image forming apparatus control method, a cartridge which can be mounted in an image forming apparatus, and a storage medium mounted in a cartridge.

BACKGROUND OF THE INVENTION

When a printing stop factor such as a toner shortage or a failure in an optical system occurs, printing is immediately stopped (e.g., see Japanese Patent Laid-Open No. 60-48658). Some color printers which use cartridges of a plurality of colors to print an image check the tone of each color and change the toner density. If a printing stop factor such as a toner shortage occurs in one of cartridges of a plurality of colors, printing is stopped even if no printing stop factor occurs in the remaining color cartridges (e.g., see Japanese Patent Laid-Open No. 60-73645).

As described above, in a conventional color printer which uses cartridges of a plurality of colors, if a printing stop factor occurs in at least one of the color cartridges, printing is stopped even if no problem such as a toner shortage occurs in the remaining color cartridges. For this reason, for example, even a printout in a single color cannot be produced using a cartridge of another color which has no problem such as a toner shortage.

To solve this problem, there is proposed an apparatus which can perform image forming in a single color using a monochrome cartridge even when, for example, a toner shortage occurs in any of color cartridges in a color printer (see, e.g., Japanese Patent Laid-Open No. 2001-83750).

However, if a toner shortage occurs in any of color cartridges in a color printer, and printing is continued using a monochrome cartridge for a long time, a problem occurs. More specifically, a cleaning blade for cleaning the image carrier of the color cartridge having run short of toner may be turned up, and an image on a printing paper sheet being conveyed may degrade.

SUMMARY OF THE INVENTION

The present invention has been proposed to solve the conventional problems, and has as its object to provide an improved image forming apparatus, image forming apparatus control method, cartridge, and storage medium.

It is another object of the present invention to provide an image forming apparatus, image forming apparatus control method, cartridge, and storage medium which can print good-quality images while increasing the utilization efficiency and operability.

It is still another object of the present invention to provide an image forming apparatus, image forming apparatus control method, cartridge, and storage medium which, if an image forming stop factor occurs in a cartridge of a certain color, enable image forming using a cartridge of another color.

To solve the above-mentioned problem, according to the present invention, there is provided an image forming apparatus which has a plurality of detachable cartridges, comprising: a controller which switches between a first mode of performing image forming using the plurality of cartridges and a second mode of, if it is determined in the first mode that a replacement timing for one of the plurality of cartridges has come, performing image forming using a predetermined cartridge whose replacement timing has not come, out of the plurality of cartridges, wherein in the second mode, the controller enables image forming in accordance with a state of the cartridge whose replacement timing is determined to have come.

To solve the above-mentioned problem, according to the present invention, there is also provided a cartridge detachable from an image forming apparatus which forms an image, comprising: a part of process means used for image forming; and storage means for, when a replacement timing for at least one of other cartridges mounted on the image forming apparatus has come, storing information for operating the cartridge in accordance with a state of the cartridge whose replacement timing has come.

To solve the above-mentioned problem, according to the present invention, there is also provided a storage medium mounted in a cartridge that is detachable from an image forming apparatus which forms an image and comprises a part of process means used for image forming, comprising: a storage area which stores information for, when a replacement timing for another cartridge mounted on the image forming apparatus has come, operating the cartridge in accordance with a state of the cartridge whose replacement timing has come.

To solve the above-mentioned problem, according to the present invention, there is also provided an image forming apparatus that has a plurality of detachable cartridges each comprising an image carrier on which a latent image is to be formed and a developing member which develops the latent image, comprising: a driving unit for operating the developing members for developing latent images formed on the image carriers of the plurality of cartridges; and a controller which controls operation of the developing members of the plurality of cartridges, wherein when a replacement timing for at least one of the plurality of cartridges has come, the controller operates a developing member of a predetermined cartridge whose replacement timing has not come in accordance with a state of the cartridge whose replacement timing has come.

To solve the above-mentioned problem, according to the present invention, there is also provided a method of controlling an image forming apparatus which has a plurality of detachable cartridges, comprising steps of: determining whether a replacement timing for one of the plurality of cartridges has come; and performing, if it is determined in the determination step that the replacement timing for the one of the plurality of cartridges has come, image forming using a predetermined cartridge whose replacement timing has not come out of the plurality of cartridges in accordance with a state of the cartridge whose replacement timing is determined to have come.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Embodiments of the present invention will be described below.

<First Embodiment>

Figure 1:
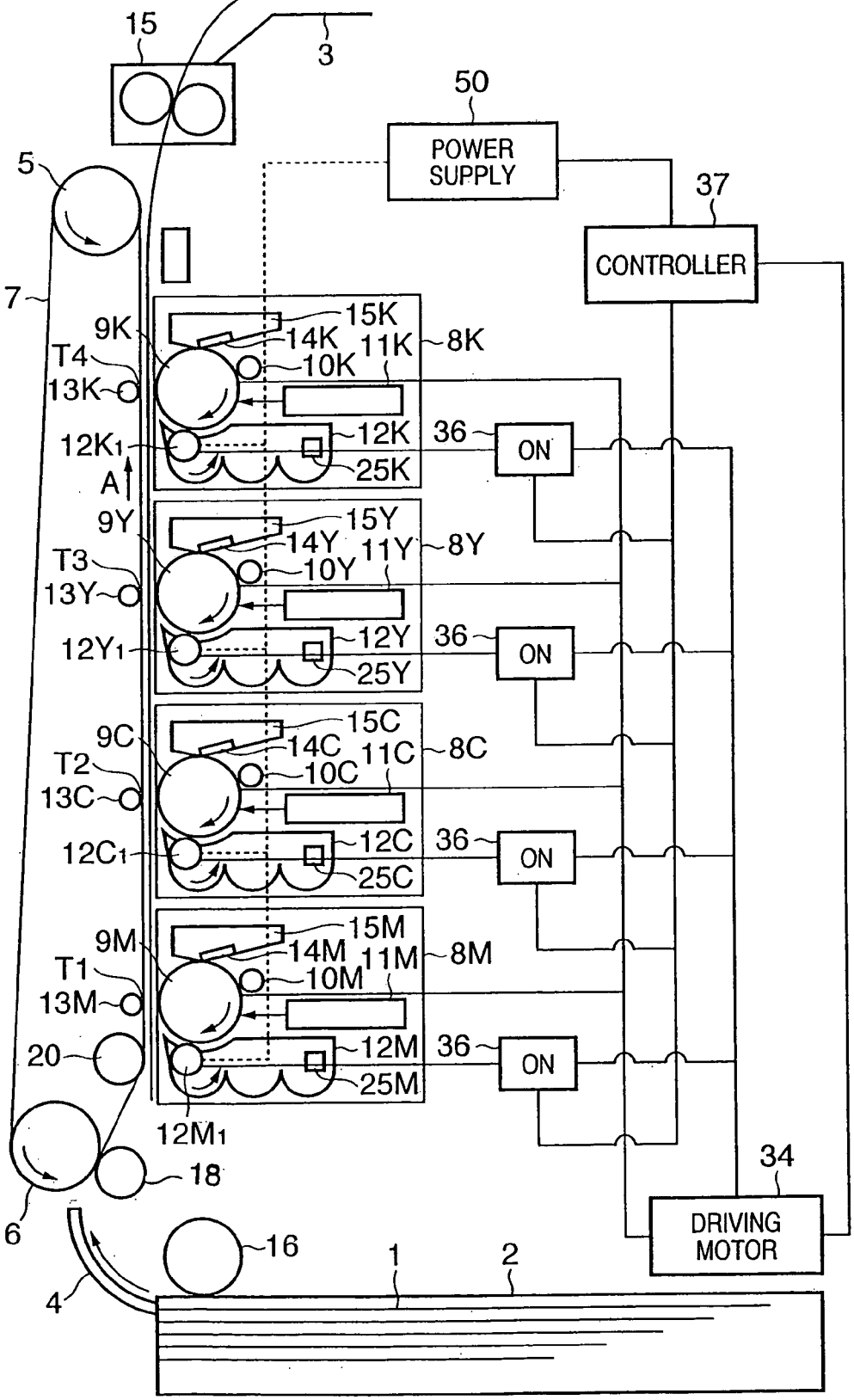
FIG. 1 is a view showing the arrangement of a full-color image forming apparatus according to the first embodiment of the present invention.

FIG. 1 is a view of the arrangement of a full-color image forming apparatus according to the first embodiment of the present invention. As shown in FIG. 1, in the full-color image forming apparatus of this embodiment, process cartridges 8M, 8C, 8Y, and 8K serving as the first, second, third, and fourth image forming means are stacked almost vertically (almost gravitational direction). The process cartridges 8M to 8K form magenta, cyan, yellow, and black images, respectively.

The process cartridges 8M to 8K have the same arrangement. In the process cartridges 8M to 8K, photosensitive drums 9M, 9C, 9Y, and 9K serving as image carriers, charging units 10M, 10C, 10Y, and 10K serving as charging means, developing units 12M, 12C, 12Y, and 12K serving as developing means which comprise developing sleeves (developing rollers) 12M1, 12C1, 12Y1, and 12K1, and cleaning blades 14M, 14C, 14Y, and 14K are integrated for each color as process means for performing image forming. The developing sleeves (developing rollers) 12M1, 12C1, 12Y1, and 12K1 serve as developing agent carriers which accommodate developing agents (toners) of the respective colors for developing latent images, carry the developing agents of the respective colors on their surfaces, and are so arranged as to oppose the photosensitive drums 9M to 9K, respectively. The process cartridges 8M to 8K comprise exposure units 11M, 11C, 11Y, and 11K on their main body sides, respectively.

The developing units 12M to 12K of this embodiment adopt a noncontact developing scheme. The developing sleeves (developing rollers) 12M1 to 12K1 serving as the developing agent carriers of the developing units 12M to 12K are held apart from the opposing photosensitive drums 9M to 9K by about 300 μm. As for the developing units 12M to 12K of this embodiment, at the time of development, a control signal is input from a controller 37 to a power supply 50 from which a developing bias is applied to each developing sleeve (developing roller). More specifically, a developing bias obtained by superposing a rectangular AC voltage and a DC voltage on each other is applied across each of the photosensitive drums 9M to 9K and the corresponding one of the developing sleeves (developing rollers) 12M1 to 12K1.

A transfer conveyor belt 7 constituting transfer material carry/convey means for carrying and conveying each of transfer materials 1 is arranged along the process cartridges 8M to 8K. The transfer conveyor belt 7 is laid across a driving roller 5, driven roller 6, and belt tension roller 20 serving as belt drive means in a taut state and rotates and moves in a direction indicated by an arrow A.

The controller 37 turns on a driving motor 34 to drive the photosensitive drums 9M to 9K of the respective process cartridges. At the same time, the controller 37 turns on all clutches 36 to drive the developing sleeves (developing rollers) 12M1 to 12K1.

A case will be described next wherein a full-color image is formed in the full-color image forming apparatus having the arrangement shown in FIG. 1.

In a full-color mode, the developing sleeves (developing rollers) 12M1 to 12K1 of the respective process cartridges 8M to 8K are all driven, as described above. For this reason, the controller 37 turns on the driving motor 34 to drive the photosensitive drums 9M to 9K of the respective process cartridges. The controller 37 also outputs signals for turning on the clutches 36 to the clutches 36 for turning on/off driving of the developing sleeves (developing rollers) 12M1 to 12K1. All the clutches 36 are turned on to drive the developing sleeves (developing rollers) 12M1 to 12K1.

When the photosensitive drum 9M is uniformly charged by the charging unit 10M in the first process cartridge 8M, it is irradiated with laser light beams corresponding to magenta image information to form an electrostatic latent image. Magenta toner of the developing unit 12M is transferred to the electrostatic latent image by the developing bias to form a magenta toner image on the photosensitive drum 9M.

The transfer materials 1 (e.g., printing paper sheets) in a paper feed unit 2 are picked up one by one by a pickup roller 16 and are fed onto the transfer conveyor belt 7 through a paper sheet path 4. Each transfer material 1 is then chucked and held on the transfer conveyor belt 7 by the action of a chuck roller 18 serving as a chucking means. The transfer material 1 is conveyed to a transfer portion T1 while being timed to the magenta toner image on the photosensitive drum 9M. A transfer unit 13M transfers the magenta toner image onto the transfer material 1.

In the second to fourth process cartridges 8C, 8Y, and 8K, a cyan toner image, yellow toner image, and black toner image are formed on the photosensitive drums 9C, 9Y, and 9K, respectively, similarly to the first process cartridge 8M. As the transfer material 1 such as a printing paper sheet is conveyed by the transfer conveyor belt 7 to transfer portions T2, T3, and T4 of the second, third, and fourth process stations 8C, 8Y, and 8K, the toner images of the respective colors are overlaid and transferred by transfer units 13C, 13Y, and 13K.

The transfer material 1 such as a printing paper sheet, onto which the toner image of the fourth color has been transferred in the process cartridge 8K at the most downstream side, is conveyed to a fixing unit 15. The toner images are fixed, and the transfer material 1 is delivered to a delivery unit 3.

Note that the cleaning blades 14M to 14K remove toners left on the photosensitive drums 9M to 9K, respectively, for printing of the next image. The removed residual toners are recovered to and accommodated in cleaning containers 15M to 15K.

A case will be described wherein only the fourth process cartridge 8K on the most downstream side performs image output, i.e., image formation. An image forming method of this type will be referred to as a "mono-color mode" hereinafter.

Figure 2:
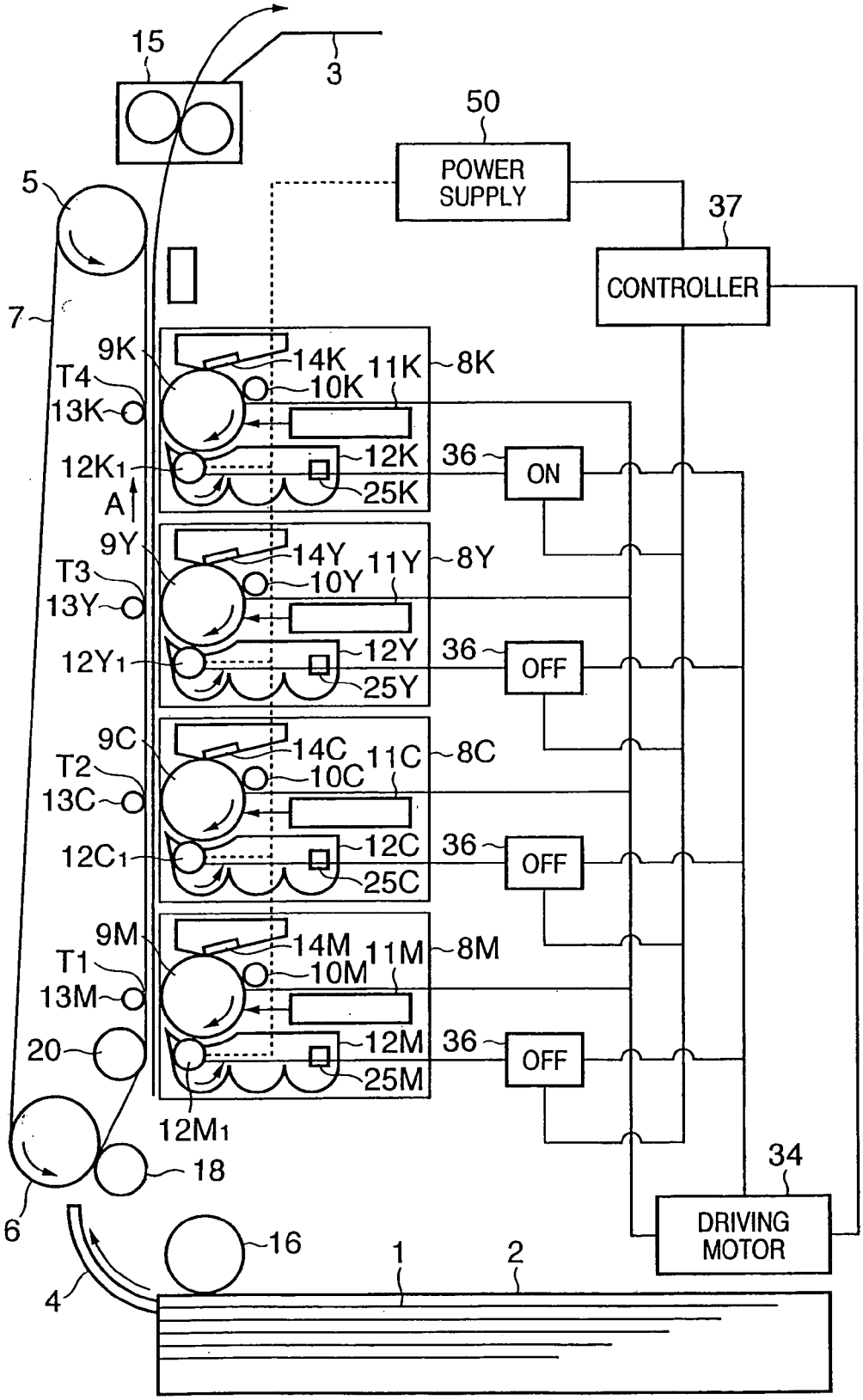
FIG. 2 is a view showing a state wherein only a fourth process cartridge 8K is driven in the full-color image forming apparatus shown in FIG. 1.

FIG. 2 is a view showing a state wherein only the fourth process cartridge 8K is driven in the full-color image forming-apparatus shown in FIG. 1.

When only the fourth process cartridge 8K on the most downstream side performs image output, the developing units 12M, 12C, and 12Y of the first to third process cartridges 8M, 8C, and 8Y on the upstream side are stopped from driving. More specifically, rotation driving of the developing sleeves (developing rollers) 12M1 to 12Y1 in the developing units 12M, 12C, and 12Y is stopped. The controller 37 outputs a signal which gives an instruction for turning on only the clutch 36 for turning on/off driving of the developing sleeve (developing roller) 12K1 out of the developing sleeves (developing rollers) 12M1, 12C1, 12Y1, and 12K1 and outputs a signal which gives an instruction for turning off the remaining clutches 36. The controller 37 drives only the developing sleeve (developing roller) 12K1 and inhibits the remaining developing sleeves (developing rollers) 12M1 to 12Y1 from driving.

In this case, a control signal from the controller 37 performs control such that a developing bias obtained by superposing a rectangular AC voltage and a DC voltage from the power supply 50 on each other is applied to only the developing sleeve (developing roller) 12K1 of the process cartridge 8K and is not applied to the developing sleeves (developing rollers) of the remaining process cartridges.

Since the developing units 12M to 12K of this embodiment adopt a noncontact developing scheme, as described above, the developing sleeves (developing rollers) 12M1 to 12K1 do not slide and rub against the photosensitive drums 9M to 9K, regardless of whether image output is performed.

At this time, the photosensitive drums 9M to 9Y of the first to third process cartridges 8M, 8C, and 8Y, which do not perform image formation, are driven in contact with the transfer conveyor belt 7 and function as conveyor rollers for conveying the transfer material 1 such as a printing paper sheet to the fourth process cartridge 8K, which performs image output. Since there is no residual transfer toner, the friction coefficients between the photosensitive drums 9M to 9Y and the cleaning blades 14M to 14Y may increase, and the blades may be turned up. To cope with this phenomenon, in this embodiment, toner is intentionally developed on the photosensitive drums every predetermined count (e.g., printing of 100 images) and is recovered between the photosensitive drums 9M to 9Y and the cleaning blades 14M to 14Y, thereby preventing cleaning blade turnup. This step will be referred to as a "toner discharge step" hereinafter.

Figure 3:
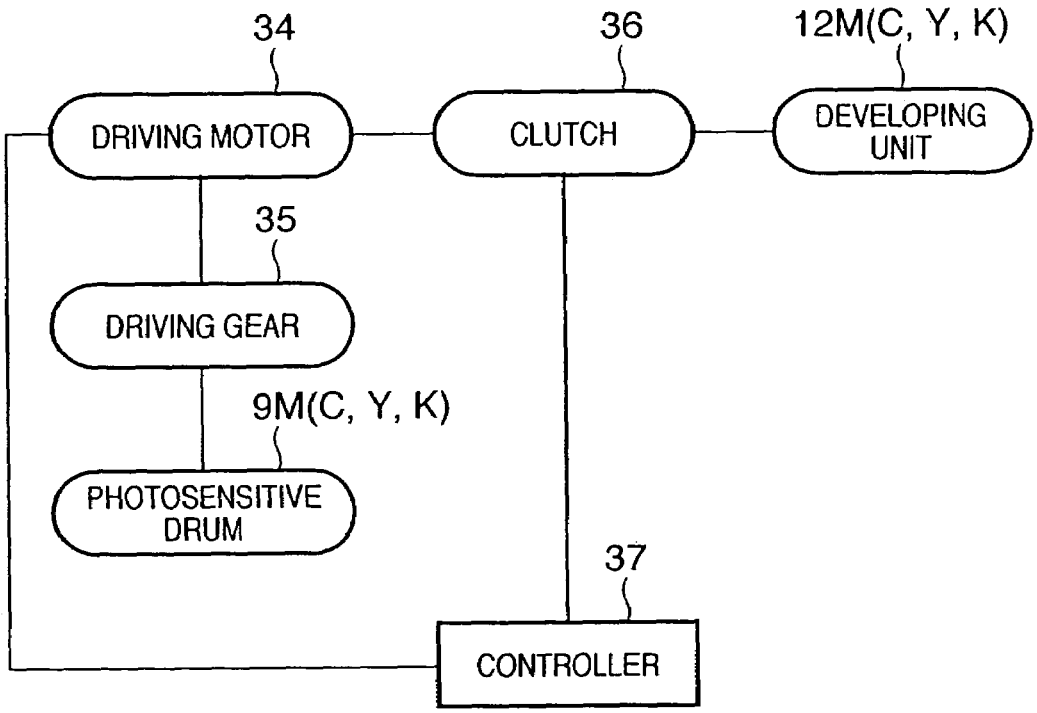
FIG. 3 is a control block diagram of the full-color image forming apparatus according to the first embodiment of the present invention.

FIG. 3 is a control block diagram of the full-color image forming apparatus according to the first embodiment of the present invention. In this embodiment, the process cartridges 8M, 8C, 8Y, and 8K mounted on the image forming apparatus have the same arrangement. Thus, the first process cartridge 8M will be exemplified. Note that the image forming apparatus has only one controller 37.

The photosensitive drum 9M and developing unit 12M are driven by the driving motor 34 serving as a driving means. More specifically, the photosensitive drum 9M is driven by the driving motor 34 through a driving gear 35. The developing unit 12M is driven by the driving motor 34 through the clutch 36 which can turn off the transmission of driving. The controller 37 serving as a control means controls to drive the driving motor 34 and clutches 36.

As described with reference to FIGS. 1 and 2, in this embodiment, the controller 37 can select some of the process cartridges 8M to 8Y as ones to be used in image forming. As for each process cartridge not to be used in image forming, the corresponding clutch 36 disables the transmission of driving to the developing unit. Each of the process cartridges 8M to 8Y may have one driving motor 34. Some of the process cartridges 8M to 8Y may share one driving motor 34. Alternatively, all the process cartridges may share one driving motor 34. In this embodiment, the driving motor 34 and the driving gear 35 constitute a means for driving the image carriers while the driving motor 34 and the clutches 36 constitute a means for driving the developing means.

An operation when an image forming stop factor occurs in at least one of the first, second, and third process cartridges 8M, 8C, and 8Y, i.e., the replacement timing for the process cartridge has come or arrived, will be described.

As for the replacement timing for each process cartridge, when it is detected that the amount of toner left in the process cartridge or the use amount of each of members constituting the process cartridge (e.g., the photosensitive drum, developing sleeve, and the like) has reached a predetermined amount, it is determined that the replacement timing for the process cartridge has come. Information about the amount of toner left and the use amount is accumulatively stored in a corresponding memory 25M, 25C, 25Y, or 25K in the process cartridge. The controller 37 reads out the information and determines the replacement timing.

In this embodiment, image forming stop can be prevented on the basis of the above-mentioned mechanism even when it is determined that the replacement timing has come, such as when any one of the process cartridges (8Y, 8M, and 8C) other than the fourth process cartridge 8K has run short of toner or the life of its developing sleeve (developing roller) has expired. Image forming in the mono-color mode can be performed for a predetermined period of time.

In the mono-color mode, as described above, the controller 37 outputs a signal which gives an instruction for turning on only the clutch 36 for on/off-controlling driving of the developing sleeve 12K1 out of the developing sleeves 12M1, 12C1, 12Y1, and 12K1 and outputs a signal which gives an instruction for turning off the remaining clutches 36. The controller 37 drives only the developing sleeve 12K1 and inhibits the remaining developing sleeves 12M1 to 12Y1 from driving. A control signal from the controller 37 performs control such that a developing bias obtained by superposing a rectangular AC voltage and a DC voltage from the power supply 50 on each other is applied to only the developing sleeve 12K1 of the process cartridge 8K and is not applied to the developing sleeves of the remaining process cartridges.

In image forming using only the process cartridge 8K, as described above, the above-mentioned "toner discharge step" needs to be performed at predetermined intervals (e.g., printing of 100 images) in order to prevent cleaning blade turnup. A process cartridge is generally determined as having run short of toner when some toner is left in the process cartridge. For this reason, toner discharge operation can be performed using the remaining toner.

However, in many cases, this residual toner degrades over a period of time until a toner shortage and has low charge amount. When development is performed in this state, a problem may occur. More specifically, even if the toner having low charge amount is supplied to the developing sleeve, it may not be transferred onto the photosensitive drum and may spill from the developing sleeve (toner leakage). If toner leakage occurs, an image printed on a transfer material may be stained with color toner. Therefore, after it is determined that any of color process cartridges has run short of toner, the toner discharge step cannot be performed to prevent cleaning blade turnup.

Since the toner discharge step cannot be performed, if monochrome printing is continued, the cleaning blade for a color cartridge having run short of toner may be turned up. When the cleaning blade is turned up, toner accommodated in the cleaning container, i.e., residual toner recovered by cleaning the photosensitive drum after the transfer of an image onto a paper sheet or toner recovered in the toner discharge step, may spill from the photosensitive drum and the turnup of the cleaning blade and may stain the interior of the main body. Also, the driving torque of the photosensitive drum may abnormally increase to cause unstable rotation of the photosensitive drum. That is, many problems may occur.

If toner spills, the interior of the apparatus may be stained, and a transfer material may be stained with the spilled toner in monochrome printing. If rotation of the photosensitive drum becomes unstable, paper conveyance in monochrome printing may become unstable to generate an unsatisfactory image.

Under the circumstances, in this embodiment, when any of the color process cartridges (8Y, 8M, and 8C) has run out of toner, control is performed in the following manner. More specifically, monochrome printing is enabled only for a predetermined period of time until when the cleaning blade which comes into contact with the photosensitive drum can be turned up. After monochrome printing is performed for the predetermined period of time, image forming operation is stopped.

In the image forming apparatus according to this embodiment, printing can be performed for a predetermined period of time such as for a predetermined print count (e.g., a printable count) or for a predetermined developing sleeve (developing roller) rotation time (e.g., the drivable time of the developing sleeve (developing roller)). Assume that image forming is stopped after any of the color process cartridges (8Y, 8M, and 8C) is determined to have run short of toner, and printing in the mono-color mode is performed for the predetermined period of time. In this case, a sufficient amount of toner may still remain in the monochrome cartridge 8K, depending on when the color process cartridge is determined to have run short of toner. That is, in some cases, image forming is stopped before the replacement timing for the monochrome cartridge 8K has come. It is apparent that if a period of time to the end of life of the process cartridge 8K is shorter than the predetermined period of time, printing can be performed until the life ends. Note that the predetermined print count or predetermined developing sleeve rotation time is determined from experimental data obtained by performing image forming a plurality of number of times while not performing the toner discharge step.

Figure 4:
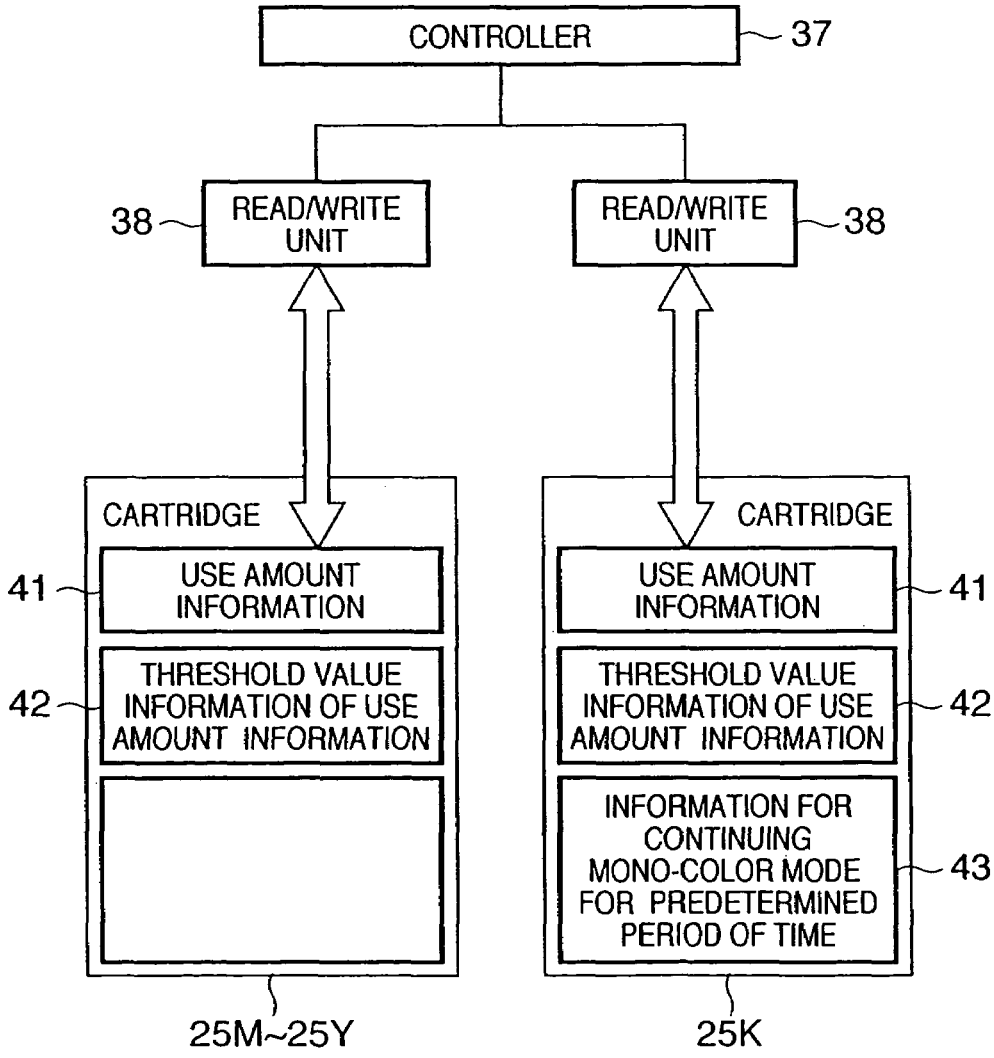
FIG. 4 is a diagram for explaining the information storage state in memory media 25M to 25Y of respective process cartridges according to the first embodiment of the present invention.

Information about a period of time as described above such as the predetermined print count or predetermined developing sleeve (developing roller) rotation time is stored in each of the nonvolatile memory media 25M to 25Y serving as fixed or detachable storage media in the respective process cartridges. Even when reset operation such as power-on/power-off of the main body is performed, the information can accurately be held if the main body is powered on again. FIG. 4 is a diagram for explaining the information storage state in the memory media 25M to 25Y of the respective process cartridges according to the first embodiment of the present invention. As shown in FIG. 4, each of the memory media 25M to 25Y of the first embodiment has an area 41 for storing the use amount information of the corresponding process cartridge and an area 42 for storing the threshold value information of the use amount information. The memory medium 25K of the fourth process cartridge has the area 41 for storing the use amount information of the corresponding process cartridge, the area 42 for storing the threshold value information of the use amount information, and an area 43 for storing information for continuing the mono-color mode for a predetermined period of time, such as the printable count or the drivable time of the developing sleeve (developing roller) described above.

Read/write units 38 for the memories of the respective process cartridges read/write data (perform communication). Read data is sent to the controller 37 and is used in processing. In writing, data are sent from the controller 37 to the read/write units 38 of the respective cartridges and are updated and stored.

It is assumed in this embodiment that no cleaning blade turnup occurs until the print count reaches 500 or the developing sleeve (developing roller) rotation time reaches a predetermined period of time corresponding to 1 hr. Information corresponding to the printable count of 500 or the developing sleeve (developing roller) drivable time of 1 hr is stored in the storage area 43 of the memory medium 25K. Image forming in the mono-color mode is allowed for the predetermined period of time on the basis of the information.

As for the life (replacement timing) of each process cartridge, the use amount information in the corresponding memory medium is successively updated and stored. When the use amount information has reached the threshold value information of the use amount stored in the memory medium, the controller 37 determines that the life of the process cartridge has expired (replacement timing).

Figure 5:
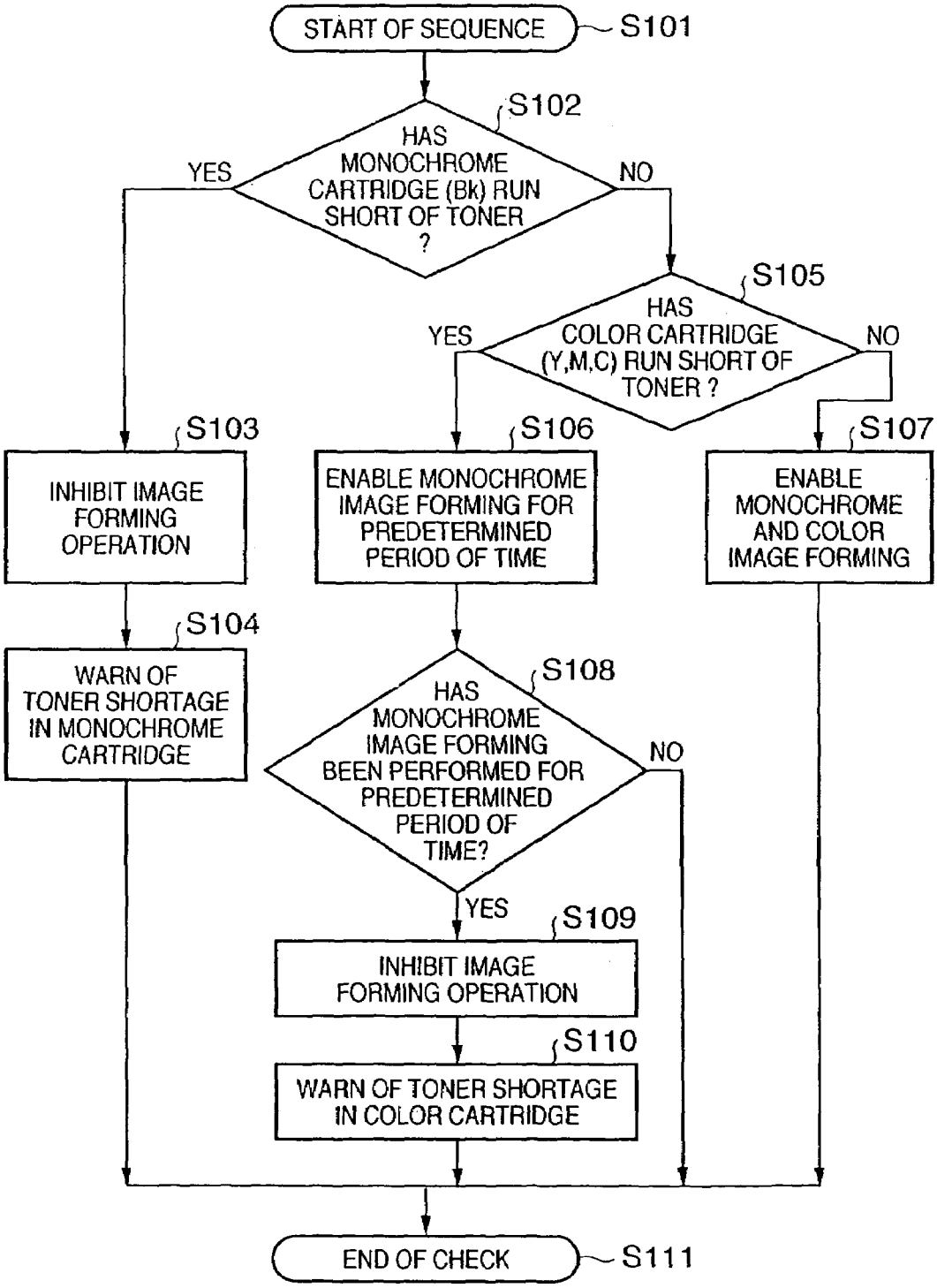
FIG. 5 is a flowchart for explaining a control flow of image forming mode setting according to the first embodiment of the present invention.

A control flow of image forming mode setting according to this embodiment will be described with reference to FIG. 5. The sequence of FIG. 5 shows control performed by the controller 37 of the image forming apparatus. The sequence is executed during an initialization sequence after the power-on of the image forming apparatus or at a timing before starting image forming operation.

In S101, the image forming mode setting sequence starts. In S102, it is checked if the monochrome toner cartridge (8K) has run short of toner. If it has run short of toner, the flow advances to S103 to inhibit image forming operation. In S104, a warning signal indicating a toner shortage in the monochrome toner cartridge is output. In S111, the check sequence ends.

If it is determined in S102 that toner is left in the monochrome toner cartridge, the flow advances to S105 to check if any of the color toner cartridges (8Y, 8M, and 8C) has run short of toner. If any cartridge has run short of toner, in S106, image forming operation is not inhibited. Image forming using the monochrome cartridge is enabled for a predetermined period of time, and monochrome image forming is continued for the predetermined period of time. On the other hand, if no color cartridge has run short of toner, in S107, the normal setting is maintained. That is, image forming is enabled both in the monochrome mode and full-color mode. In S111, the check sequence ends.

In S108, it is checked whether monochrome image forming is performed for the predetermined period of time (a predetermined print count or predetermined developing roller driving time). If monochrome image forming is performed for less than the predetermined period of time, the check sequence ends in S111. On the other hand, if monochrome image forming is performed for the predetermined period of time or more, image forming operation is inhibited in S109. In S110, a warning signal indicating a toner shortage in a color cartridge determined in S105 to have run short of toner is output. In S111, the check sequence ends.

A warning signal indicating a toner shortage described in S104 and S110 may be output from the CPU 37 of the image forming apparatus to a display unit (not shown) provided in the image forming apparatus and may be displayed. Alternatively, the warning signal may be output from the CPU 37 to a host computer (not shown) connected to the image forming apparatus, and the user may be notified of the warning signal.

As described above, according to this embodiment, image forming is not immediately inhibited, and image forming in the mono-color mode using the fourth process cartridge 8K can be performed for a predetermined period of time, even upon occurrence of a printing stop factor such as a toner shortage or the expiration of the life of the developing sleeve (developing roller) of at least one of the first to third process cartridges 8M to 8Y excluding the process cartridge 8K. For example, if the user purchases a spare process cartridge of the same type as the process cartridge, which has caused printing stop, during the predetermined period of time, unnecessary machine down time can be avoided, and the utilization efficiency and reliability of the image forming apparatus (printer) can be increased.

<Second Embodiment>

The first embodiment has described the noncontact developing scheme in which the developing sleeves (developing rollers) 12M1 to 12K1 and the photosensitive drums 9M to 9K are held apart from each other. A contact developing scheme in which developing sleeves (developing rollers) 12M1 to 12K1 and photosensitive drums 9M to 9K come into contact can produce the same effect. In the contact developing scheme, the photosensitive drums and developing sleeves only need to be spaced apart from each other in the monochrome mode.

The first embodiment has described the image forming apparatus, in which the process cartridges 8M, 8C, 8Y, and 8K are stacked almost vertically (almost gravitational direction). Even if process cartridges are arranged horizontally, the same effect can be obtained.

The first embodiment has described a case wherein only the fourth process cartridge is driven if an image forming stop factor occurs in at least one of the first to third process cartridges 8M, 8C, and 8Y. The process cartridges other than the fourth process cartridge, in which no image forming stop factor occurs, may be driven. The operation principle at this time is the same as the above-mentioned embodiments.

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Examples of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

The present invention is not limited to the above embodiments and various changes and modifications can be made within the spirit and scope of the present invention, within which the following claims are made.

CLAIM OF PRIORITY

This application claims priorities from Japanese Patent Application No. 2003-204819 filed on Jul. 31, 2003 and Japanese Patent Application No. 2004-207976 filed on Jul. 15, 2004, which are hereby incorporated by reference herein.

What is claimed is:

1. An image forming apparatus which has a plurality of detachable cartridges, each comprising an image carrier, a charging member for charging the image carrier, a developing member for developing a latent image formed on the image carrier, and a cleaning member for cleaning a surface of the image carrier, comprising a controller which switches between a first mode of performing image forming using the plurality of cartridges and a second mode of, if determined in the first mode that a replacement timing for one of the plurality of cartridges has arrived, performing image forming using a predetermined cartridge whose replacement timing has not arrived, out of the plurality of cartridges, wherein in the second mode, said controller enables image forming for a period corresponding to a state of the cleaning member of the cartridge whose replacement timing is determined to have arrived.

2. The apparatus according to claim 1, wherein the predetermined cartridge is a cartridge which contains a black developing agent.

3. The apparatus according to claim 1, wherein the plurality of cartridges contain yellow, magenta, cyan, and black developing agents, respectively, and when a replacement timing for at least one of the cartridges which contain the yellow, cyan, and magenta developing agents has arrived in the second mode, said controller does not operate the cartridges of yellow, cyan, and magenta but operates the cartridge of black for a predetermined period of time to perform image forming.

4. The apparatus according to claim 1, further comprising storage means for storing information for enabling image forming in accordance with the state of the cleaning member of the cartridge whose replacement timing is determined to have arrived in the second mode.

5. The apparatus according to claim 4, wherein the information for enabling image forming in accordance with the state of the cleaning member of the cartridge whose replacement timing is determined to have arrived includes information about a printable count or information about a drivable time of the cartridge.

6. The apparatus according to claim 1, wherein said controller stops an image forming operation after image forming for the period even if the replacement timing for the predetermined cartridge has not arrived.

7. A cartridge detachable from an image forming apparatus which forms an image, comprising:

an image carrier;

a charging member for charging said image carrier;

a developing member for developing a latent image formed on said image carrier;

a cleaning member for cleaning said image carrier; and a storage portion which stores information for, when a replacement timing for at least one of other cartridges mounted on the image forming apparatus has arrived, operating the image forming apparatus for a period corresponding to a state of the cleaning member of the cartridge whose replacement timing has arrived.

8. The cartridge according to claim 7, containing black developing agent.

9. The cartridge according to claim 7, wherein the information for operating includes information about a printable count or information about a drivable time of the cartridge.

10. A storage medium mounted in a cartridge that is detachable from an image forming apparatus which forms an image and comprises an image carrier, a charging member for charging the image carrier, a developing member for developing a latent image formed on the image carrier, and a cleaning member for cleaning a surface of the image carrier, comprising a storage area which stores information for, when a replacement timing for another cartridge mounted on the image forming apparatus has arrived, operating the cartridge for a period corresponding to a state of the cleaning member of the cartridge whose replacement timing has arrived.

11. The medium according to claim 10, wherein the information for operating includes information about a printable count or information about a drivable time of the cartridge.

12. An image forming apparatus that has a plurality of detachable cartridges, each comprising an image carrier on which a latent image is to be formed, a developing member which develops the latent image, and a cleaning member which cleans the image carrier, comprising:

a driving unit for operating the developing members for developing latent images formed on the image carriers of the plurality of cartridges; and a controller which controls operation of the developing members of the plurality of cartridges, wherein when a replacement timing for at least one of the plurality of cartridges has arrived, said controller operates a developing member of a predetermined cartridge whose replacement timing has not arrived for a period corresponding to a state of the cleaning member of the cartridge whose replacement timing has arrived.

13. The apparatus according to claim 12, wherein the predetermined cartridge is a cartridge which contains a black developing agent.

14. The apparatus according to claim 12, wherein the plurality of cartridges contain yellow, magenta, cyan, and black developing agents, respectively, and when a replacement timing for at least one of the cartridges which contain yellow, cyan, and magenta developing agents has arrived, said controller does not operate the developing members of the yellow, cyan, and magenta cartridges but operates the developing member of the cartridge of black for a predetermined period of time to perform image forming.

15. The apparatus according to claim 12, wherein the predetermined cartridge further comprises a storage medium which stores information for driving the developing member in the cartridge.

16. The apparatus according to claim 15, wherein the information for driving the developing member includes information about a printable count or information about a drivable time of the developing member.

17. A method of controlling an image forming apparatus which has a plurality of detachable cartridges, each comprising an image carrier, a charging member for charging the image carrier, a developing member for developing a latent image formed on the image carrier, and a cleaning member for cleaning a surface of the image carrier, comprising steps of:

determining whether a replacement timing for one of the plurality of cartridges has arrived; and performing, if determined in the determining step that the replacement timing for the one of the plurality of cartridges has arrived, image forming using a predetermined cartridge whose replacement timing has not arrived out of the plurality of cartridges for a period corresponding to a state of the cleaning member of the cartridge whose replacement timing is determined to have arrived.

18. The method according to claim 17, further comprising a step of stopping an image forming operation after image forming for the period even if the replacement timing for the predetermined cartridge has not arrived.

19. An image forming apparatus which has a plurality of detachable cartridges, each comprising an image carrier, a charging member for charging the image carrier, a developing member for developing a latent image formed on the image carrier, and a cleaning member for cleaning a surface of the image carrier, comprising:

a determination unit which determines whether a replacement timing for one of the plurality of cartridges has arrived; and a controller which performs setting such that image forming is performed using a predetermined cartridge whose replacement timing has not arrived, out of the plurality of cartridges, if determined that the replacement timing for the one of the plurality of cartridges has arrived, wherein said controller performs setting such that image forming is performed for a period corresponding to a state of the cleaning member of the cartridge whose replacement timing is determined to have arrived.

* * * * *